US006602354B2

(12) United States Patent
Kanematsu et al.

(10) Patent No.: US 6,602,354 B2
(45) Date of Patent: Aug. 5, 2003

(54) METHOD FOR PRODUCING A TIN-NICKEL ALLOY FILM

(75) Inventors: Hideyuki Kanematsu, Suzuka (JP); Tatsumasa Kobayashi, Yokkaichi (JP); Takeo Oki, Tsushima (JP)

(73) Assignee: Suzuka National College of Technology, Suzuka (JP)

( * ) Notice: Subject to any disclaimer, the term of this patent is extended or adjusted under 35 U.S.C. 154(b) by 0 days.

(21) Appl. No.: 09/862,711

(22) Filed: May 23, 2001

(65) Prior Publication Data

US 2002/0046787 A1 Apr. 25, 2002

(30) Foreign Application Priority Data

Oct. 24, 2000 (JP) ..... 2000-323631

(51) Int. Cl.[7] ..... C23C 22/00

(52) U.S. Cl. ..... 148/240; 148/242; 427/376.8; 427/405

(58) Field of Search ..... 148/240, 242; 427/376.8, 405

(56) References Cited

U.S. PATENT DOCUMENTS 4,601,957 A * 7/1986 Fujimoto et al. ..... 205/111
5,993,994 A * 11/1999 Ohmura et al. ..... 428/648
6,527,881 B2 * 3/2003 Kanematsu et al. ..... 148/525

OTHER PUBLICATIONS

Matsuyoshi, H., *Development of Sn–Ni alloy film having large oxidation resistance at higher temperature,* The Surface Finishing Society of Japan, Sep., 2000.

Sonoda, T., et al., *Structure and Properties of Bright Tin–Nickel Alloy Films Formed By Thermal Diffusion Method,* The Surface Finishing Society of Japan, vol. 45, No. 2, 1994, pp. 197–201. (No month data).

Yoshimura, S., et al., *Corrosion Resistance of Tin–Nickel Alloy Films Formed by Heating Diffusion Treatment,* The Surface Finishing Society of Japan, vol. 44, No. 2, 1993, pp. 176–178. (No month data).

* cited by examiner

*Primary Examiner*—John Sheehan
*Assistant Examiner*—Andrew L. Oltmans
(74) *Attorney, Agent, or Firm*—Burns, Doane, Swecker & Mathis, LLP

(57) ABSTRACT

A tin layer and a nickel layer are stacked sequentially on a given substrate to form a multilayered film composed of the tin layer and the nickel layer. Then, the multilayered film is heated to a given temperature to form a tin-nickel alloy film through the diffusion of the tin elements of the tin layer into the nickel layer.

4 Claims, 3 Drawing Sheets

| peak No. | 2θ (experiment) | 2θ (JCPDS card) | compounds |
|---|---|---|---|
| ① | 26.46 | 26.61 | $SnO_2$ |
| ② | 29.32 | 29.84 | NiSn |
| ③ | 29.70 | 29.85 | NiSn |
| ④ | 30.30 | 30.27 | $Ni_3Sn_4$ |
| ⑤ | 31.56 | 31.44 | NiSn |
| ⑥ | 33.16 | 33.33 | NiSn |
| ⑦ | 39.32 | 39.27 | $Ni_3Sn$ |
| ⑧ | 43.18 | 43.30 | NiSn |

| peak No. | 2θ (experiment) | 2θ (JCPDS card) | compounds |
|---|---|---|---|
| ① | 26.46 | 26.61 | $SnO_2$ |
| ② | 29.32 | 29.84 | NiSn |
| ③ | 29.70 | 29.85 | NiSn |
| ④ | 30.30 | 30.27 | $Ni_3Sn_4$ |
| ⑤ | 31.56 | 31.44 | NiSn |
| ⑥ | 33.16 | 33.33 | NiSn |
| ⑦ | 39.32 | 39.27 | $Ni_3Sn$ |
| ⑧ | 43.18 | 43.30 | NiSn |

| peak No. | 2θ (experiment) | 2θ (JCPDS card) | compounds |
|---|---|---|---|
| ① | 26.62 | 26.61 | $SnO_2$ |
| ② | 29.36 | 28.60 | $Ni_3Sn$ |
| ③ | 30.48 | 30.77 | $Ni_3Sn_2$ |
| ④ | 31.72 | 31.44 | NiSn |
| ⑤ | 33.26 | 33.33 | NiSn |
| ⑥ | 39.44 | 39.27 | $Ni_3Sn$ |
| ⑦ | 43.32 | 43.53 | $Ni_3Sn_2$ |

METHOD FOR PRODUCING A TIN-NICKEL ALLOY FILM

BACKGROUND OF THE INVENTION

1) Field of the Invention

This invention relates to a method for producing a tin-nickel alloy film, particularly a method for producing a tin-nickel alloy film for decorative purposes.

2) Description of the Prior Art

Recently, attention has been paid to a tin-nickel alloy film to replace a decorative chromium plating film. Although the chromium plating film has some excellent properties such as wear-resistance and corrosion-resistance, it is strictly restricted in use because it has harmful element, Cr with respect to the environment. The use of the chromium plating film is expected to be more severely restricted in the future. Therefore, the tin-nickel alloy film would play very important roles in the future instead of the chromium plating film.

In the past, the tin-nickel film would be produced from a given water solution by alloy-electroplating, and thus, two different metals, tin and nickel, must be electroplated at the same voltage. Then, all kinds of things to perform the electroplating at the same voltage have been carried out. Moreover, chemical species to be used have been restricted, and anti-environmental additives have been used.

Furthermore, the above electroplated tin-nickel film from the water solution always has a non-equilibrium NiSn phase which is not recognized in its equilibrium diagram. The NiSn phase often shifts to another stable phase due to the wear or the heating in the use of the tin-nickel alloy film, and thus, the properties of the tin-nickel alloy film often change. Therefore, the functions given to the tin-nickel alloy film for predetermined purposes may change during the use of the film, so that it may be that the tin-nickel alloy film can not exhibit the predetermined functions.

In the above case, various modifications in electroplating condition and additives have been performed for preventing the occurrence of the unstable NiSn phase, but can not generate another stable phase except the unstable NiSn phase.

SUMMARY OF THE INVENTION

It is an object of the present invention to provide a method for producing a stable tin-nickel alloy film not including a non-equilibrium NiSn phase.

For achieving the above object, this invention relates to a method for producing a tin-nickel alloy film comprising the steps of:

depositing a tin layer and a nickel layer on a given substrate sequentially, thereby to form a multilayered film composed of the tin layer and the nickel layer, and heating the multilayered film at a given temperature to form the tin-nickel alloy film.

The inventors have intensely studied to obtain the tin-nickel alloy film not including a non-equilibrium NiSn phase. As a result, they have found out a new method for producing the above tin-nickel alloy film in which films made of tin or nickel which is the component in the tin-nickel alloy film are stacked to form a multilayered film, and then, the multilayered film is heated to a given temperature to diffuse the tin elements and the nickel elements into the respective opposite layers, and thus, obtain the tin-nickel alloy film.

That is, according to the present invention, the tin-nickel alloy film is produced indirectly through the diffusion of the tin elements to constitute the tin-film and the nickel elements to constitute the nickel film.

Therefore, even though the non-equilibrium NiSn phase is generated, it is shifted to another stable NiSn phase in the heat-diffusion process of the present invention. As a result, since the thus obtained tin-nickel alloy film does not have the non-equilibrium NiSn phase, different from the above electroplated tin-nickel alloy film, it can maintain its original properties in use, and the original functions given to the tin-nickel alloy film can be maintained for a long time.

BRIEF DESCRIPTION OF THE DRAWINGS

For better understanding of the present invention, reference is made to the attached drawings, wherein.

DESCRIPTION OF THE PREFERRED EMBODIMENTS

Figure 1:
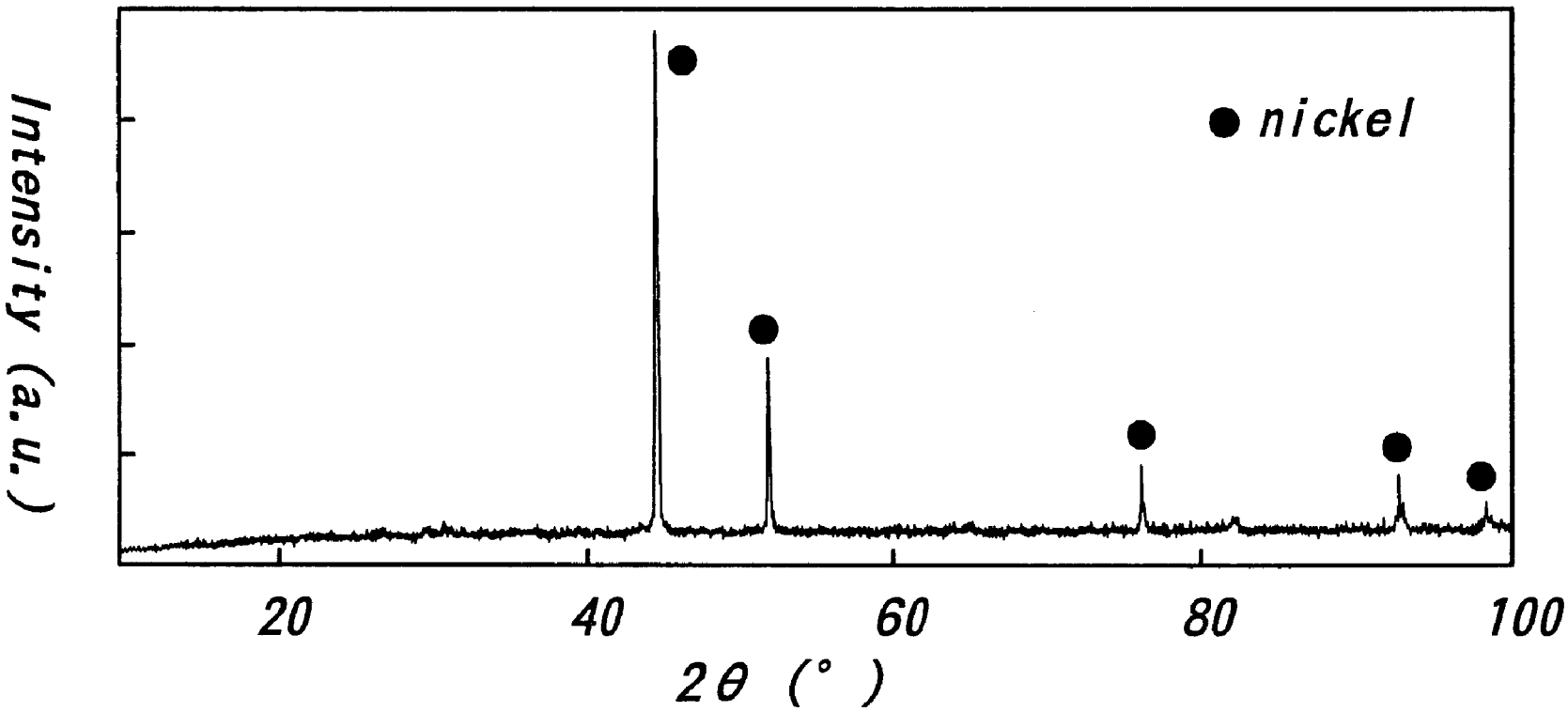
FIG. 1 is a X-ray diffraction profile of a tin-nickel alloy film obtained by the producing method of the present invention.

This invention will be described in detail by way of examples with reference to the accompanying drawings.

In the present invention, it is required that a multilayered film composed of a tin layer and a nickel layer is formed and heated to a given temperature. The heating process is preferably carried out at a temperature not less than the melting point of tin. In this case, since the tin layer is melted, and the thus obtained liquid tin diffuses fast into the nickel layer, the tin-nickel alloy film can be produced simply in a shorter time.

For example, although it takes several hours in the heating process at a temperature not less than the melting point of tin, it takes several days in the heating process at a temperature less than the melting point of tin.

Moreover, the upper limited temperature in the heating process is not particularly restricted, and is determined on the properties of a whole control system or a furnace for the heating process. Generally, the upper limited temperature is about 400° C. Even though the heating process is carried out at a temperature more than the upper limited temperature, it can not almost improve the properties of the thus obtained tin-nickel alloy film. Herein, the melting point of tin is about 232° C.

Moreover, the stacking order of the tin layer and the nickel layer constituting the multilayered film is not particularly restricted, but it is desired to stack the nickel layer and the tin layer in turn.

In the case of forming the nickel layer on the tin layer to form the multilayered film, first, the tin layer is electroplated on a given substrate, and thereafter, the nickel layer is formed from a strong acidic bath such as a watts nickel bath. Therefore, the tin layer is dipped into the strong acidic bath for a long time during the formation of the nickel layer. As a result, the tin layer is partially melted and reduced in its thickness.

If the tin-nickel alloy film is formed of the above obtained multilayered film, the tin content of the alloy film is decreased and the kind of stable phase is restricted. Therefore, for obtaining the tin nickel alloy film having a desired tin content, the tin layer has to be formed thicker by compensating the thickness of the tin layer to be reduced.

On the other hand, if the tin-nickel alloy is formed of the multilayered film in which the nickel layer and the tin layer are stacked in turn, the tin layer is not dipped into the strong acidic bath and thus, not reduced in its thickness. As a result, the tin nickel alloy film having a desired tin content can be easily formed.

Moreover, it is preferable that the thickness of the tin layer is 10–50 $\mu$m, and the thickness of the nickel layer is 10–50 $\mu$m. Thereby, the tin-nickel alloy film obtained through the subsequent heating process can have various stable phases.

Then, if the tin layer and the nickel layer have the above thickness, the fluctuation margin in the electroplating condition for forming the above tin layer and nickel layer is allowable to some degree. That is, even though the electroplating condition for forming the tin layer and the nickel layer is fluctuated slightly, the tin layer and the nickel layer can have thicknesses within the above thickness range, respectively.

Although the tin layer and the nickel layer are deposited on a given substrate, the depositing method is not particularly limited. However, the tin layer and the nickel layer are preferably electroplated on the given substrate because the electroplating can form the layers thicker in a relatively short time and the operationality of the electroplating becomes easy.

In forming the tin layer by the electroplating method, an electroplating bath such as an acidic bath or an alkaline bath may be used. A sulfuric acid bath, a methanesulfonic acid bath or a tetrafluoroboric acid bath may be exemplified as the acidic bath. In forming the nickel layer by the electroplating method, an electroplating watts nickel bath may be employed.

The tin nickel alloy film not including a non-equilibrium NiSn phase can be obtained through the above process according to the present invention. Then, the alloy film has preferably at least one of $Ni_3Sn$ phase, $Ni_3Sn_2$ phase and $Ni_3Sn_4$ phase. Thereby, the properties of the alloy film, that is, the functions given to the alloy film can be maintained for a long time.

EXAMPLES

This invention is concretely described on the following examples, but is not restricted to the examples.

Example 1

A pure iron plate having a thickness of 2 mm as a substrate was immersed into a fluoroboric acid bath having a total amount of 300 ml which was composed of 18 ml of 42%-boric hydrofluoric acid, 2 ml of 44.6%-fluoroboric tin and 15 mg of polyethylene glycol(molecular weight=2000). Then, the fluoroboric acidic bath was electrolyzed by flowing a current at a current density of 1 A/dm$^2$ for five minutes to form a tin layer in a thickness of 30 $\mu$m on the iron plate.

Then, the iron plate having the tin layer thereon was immersed into a watts nickel bath having a total amount of 300 ml which was composed of 15 g of nickel chloride-hexahydrate, 90 g of nickel sulphate and 12 g of boric acid, and the watts nickel bath was electrolyzed by flowing a current at a current density of 5 A/dm$^2$ for five minutes to form a nickel layer in a thickness of 30 $\mu$m on the tin layer. During the formation of the multilayered film composed of the above tin layer and nickel layer, it was recognized that the thickness of the tin layer was reduced up to several $\mu$m.

Next, the iron plate having the above multilayered film was set into an electric furnace, and heated at 200° C. for several days. As a result, the tin layer disappeared perfectly and it was turned out that the tin elements diffused into the nickel layer in 7–10 days heating.

FIG. 1 is a X-ray diffraction profile of the tin nickel alloy film obtained through the 10 days-heating process at 200° C. As is apparent from FIG. 1, the tin layer disappeared and the tin elements diffused into the nickel layer.

Example 2

A pure iron plate having a thickness of 2 mm as a substrate was immersed into a watts nickel bath having a total amount of 300 ml which was composed of 15 g of nickel chloride-hexahydrate, 90 g of nickel sulphate and 12 g of boric acid, and the watts nickel bath was electrolyzed by flowing a current at a current density of 5 A/dm$^2$ for five minutes to form a nickel layer in a thickness of 30 $\mu$m on the iron plate.

Then, the iron plate was immersed into a fluoroboric acidic bath having a total amount of 300 ml which was composed of 18 ml of 42%-boric hydrofluoric acid, 2 ml of 44.6%-fluoroboric tin and 15 mg of polyethylene glycol (molecular weight=2000). Then, the fluoroboric acidic bath was electrolyzed by flowing a current at a current density of 1 A/dm$^2$ for five minutes to form a tin layer in a thickness of 30 $\mu$m on the nickel layer, and thus, form a multilayered film composed of the nickel layer and the tin layer stacked in turn.

Then, the iron plate having the above multilayered film was set into an electric furnace, and heated at 200° C. for several days. As a result, it was turned out that the tin layer disappeared perfectly through the six days-heating process and the tin elements diffused into the nickel layer. Moreover, it was turned out that subsequent heating process can generate stable phase such as $Ni_3Sn$ phase, $Ni_3Sn_2$ phase or $Ni_3Sn_4$ phase.

Figure 2:
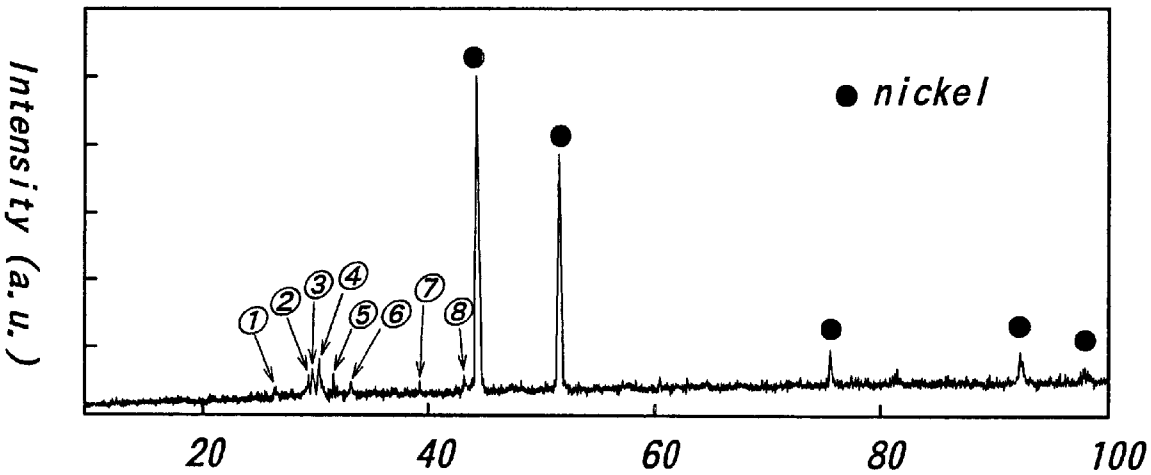
FIG. 2 is another X-ray diffraction profile of a tin-nickel alloy film obtained by the producing method of the present invention.
Figure 3:
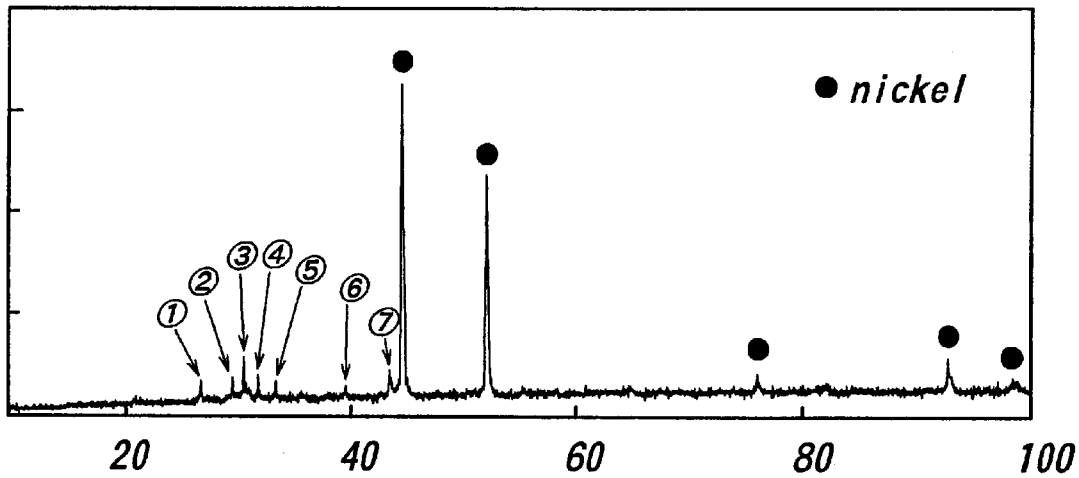
FIG. 3 is still another X-ray diffraction profile of a tin-nickel alloy film obtained by the producing method of the present invention.

FIGS. 2 and 3 are X-rays diffraction profiles of the respective tin-nickel alloy films obtained by the seven days-heating process and the ten days-heating process at 200° C. As is apparent from FIGS. 2 and 3, the seven days-heating process generates stable $Ni_3Sn$ phase and $Ni_3Sn_4$ phase in the alloy film, and the ten days-heating generates stable $Ni_3Sn$ phase and $Ni_3Sn_2$ phase. As a result, it is turned out that the properties of the alloy films can be developed.

Example 3

Except that the heating process was carried out at 400° C., the tin-nickel alloy film was produced by the same manner as in the above Example 2. The tin layer disappeared in several hours-heating, and the about three hours-heating process turned out to generate stable $Ni_3Sn$ phase, $Ni_3Sn_2$ phase and $Ni_3Sn_4$ phase in the thus obtained tin-nickel alloy film.

Comparative Example

A pure iron plate was immersed into a bath having a total amount of 300 ml composed of 80 g of nickel chloride-hexahydrate, 17 g of tin chloride-dihydrate, 11 g of ammonium difluoride and 28 g of sodium fluoride. Then, the bath was electrolyzed at 70° C. by flowing a current at a cathode current density of 4 A/cm$^2$ for five minutes to form a tin-nickel alloy film in a thickness of 15 $\mu$m.

When the alloy film was investigated by X-ray diffraction, it was turned out that the alloy film had an unstable NiSn phase.

Although the present invention was described in detail with reference to the above examples, this invention is not limited to the above disclosure and every kind of variation and modification may be made without departing from the scope of the present invention.

As is explained above, according to the present invention, a tin-nickel alloy film not including an unstable NiSn phase can be provided. Therefore, the change in the properties of the alloy film can be repressed regardless of the wear and the heating in use. As a result, the functions given to the alloy film can be maintained for a long time.

What is claimed is:

1. A method for producing a tin-nickel alloy film comprising the steps of:

depositing a tin layer and a nickel layer on a given substrate sequentially, thereby to form a multilayered film composed of the tin layer and the nickel layer wherein the thickness of the tin layer is 10–50 $\mu$m, and the thickness of the nickel layer is 10–50 $\mu$m, and heating the multilayered film in a furnace at a temperature not less than the melting point of tin to form the tin-nickel alloy film having $Ni_3Sn$ phase, $Ni_3Sn_2$ phase and $Ni_3Sn_4$ phase.

2. A method for producing a tin-nickel alloy film as defined in claim 1, wherein the tin layer and the nickel layer are deposited by an electroplating method.

3. A method for producing a tin-nickel alloy film comprising the steps of:

depositing a tin layer and a nickel layer on a given substrate sequentially, thereby to form a multilayered film composed of the tin layer and the nickel layer wherein the thickness of the tin layer is 10–50 $\mu$m, and the thickness of the nickel layer is 10–50 $\mu$m, and heating the multilayered film in a furnace at a given temperature to form the tin-nickel alloy film having $Ni_3Sn$ phase, $Ni_3Sn_2$ phase and $Ni_3Sn_4$ phase.

4. A method for producing a tin-nickel alloy film as defined in claim 3, wherein the tin layer and the nickel layer are deposited by an electroplating method.

* * * * *